US006851224B2

(12) United States Patent
Lehnert

(10) Patent No.: US 6,851,224 B2
(45) Date of Patent: Feb. 8, 2005

(54) ENVELOPING ELEMENT FOR A BUILDING

(75) Inventor: Stefan Lehnert, Bremen (DE)

(73) Assignee: Foiltec Verarbeitung von Folien und Textilien GmbH (DE)

( * ) Notice: Subject to any disclaimer, the term of this patent is extended or adjusted under 35 U.S.C. 154(b) by 0 days.

(21) Appl. No.: 10/397,961

(22) Filed: Mar. 26, 2003

(65) Prior Publication Data

US 2004/0079046 A1 Apr. 29, 2004

(30) Foreign Application Priority Data

Mar. 26, 2002 (DE) ..... 202 04 840 U

(51) Int. Cl.[7] ..... E04H 15/20

(52) U.S. Cl. ..... 52/2.22; 52/2.23; 52/2.24; 52/2.25; 52/79; 52/409

(58) Field of Search ..... 52/3–5, 408–413, 52/2.11, 2.13–2.16, 2.21–2.26, 79, 79.9

(56) References Cited

U.S. PATENT DOCUMENTS 3,975,915 A * 8/1976 Haw ..... 405/110
4,567,696 A * 2/1986 Malet ..... 52/2.25
4,856,228 A * 8/1989 Robinson, Sr. ..... 47/29.1
4,887,627 A * 12/1989 Audet ..... 135/120.1
5,247,768 A * 9/1993 Russo ..... 52/2.13
5,379,555 A * 1/1995 Strieb et al. ..... 52/3
5,837,586 A * 11/1998 Perron ..... 430/285.1
6,070,366 A * 6/2000 Pierson ..... 52/2.17
6,224,139 B1 * 5/2001 Weyand ..... 296/100.16
6,329,038 B1 * 12/2001 Christoffersen ..... 428/68
6,363,661 B1 * 4/2002 Myers ..... 52/2.13
6,708,451 B1 * 3/2004 Gomes ..... 52/2.17

FOREIGN PATENT DOCUMENTS

DE 90 00 940.0 1/1990
EP 0 306 717 8/1988

* cited by examiner

*Primary Examiner*—Jeanette Chapman
(74) *Attorney, Agent, or Firm*—Altera Law Group, LLC

(57) ABSTRACT

Described is a covering element for buildings comprising at least one, preferably fixedly arranged support apparatus and at least one film pillow that displays two outer film layers, between which is formed at least one hollow space closed in a gastight manner and containing gas, especially air, and displays a fastening section in which the two outer film layers are connected to each other and by which section the film pillow is anchored to the support apparatus. The special aspect of this covering element for buildings consists in the fact that at least one thermally insulating element is arranged in the fastening section of the film pillow and in the fact that the two outer film layers are spaced apart from each other by the thermally insulating element and thereby rest upon the latter.

11 Claims, 2 Drawing Sheets

ENVELOPING ELEMENT FOR A BUILDING

Figure 1:
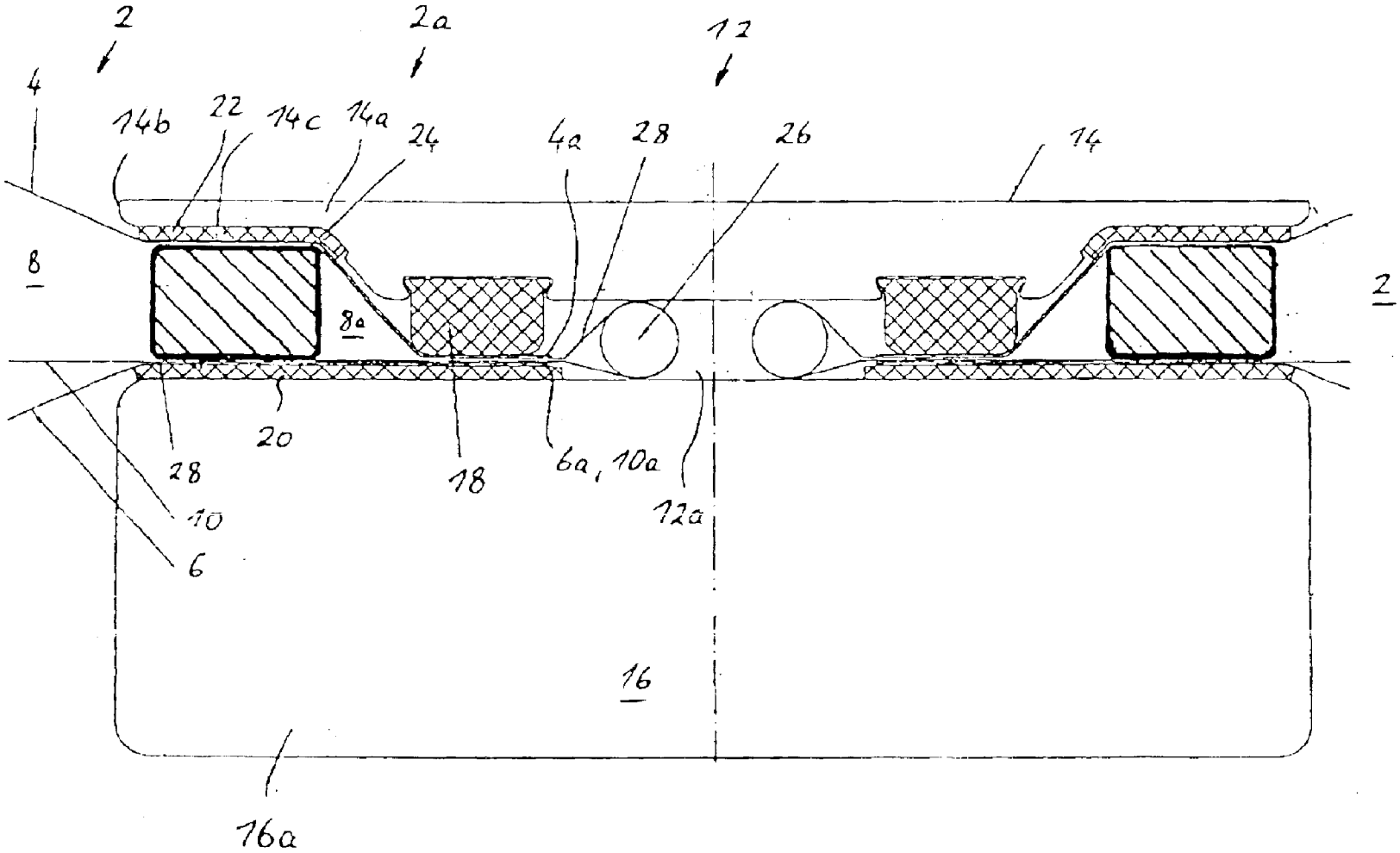

The invention relates to a covering element for buildings comprising at least one, preferably fixedly arranged support apparatus and at least one film pillow that displays two outer film layers, between which is formed at least one hollow space closed in a gastight manner and containing gas, especially air, and displays a fastening section in which the two outer film layers are connected to each other and by which section the film pillow is anchored to the support apparatus.

Such covering elements for buildings are known and, among other applications, have long been used to form film roof systems as well as film facade systems. Film roof systems and film facade systems are used especially in the construction of shopping centers, gymnasia, amusement parks, and other commercial buildings for which a conventional roofing is not recommended, whether for structural or economic reasons.

The film pillow is formed through at least two outer film layers that are connected to each other in a gastight manner, usually welded together along their edges, in order to form between the layers a hollow space closed in a gastight manner. During the production of the film pillow, gas, especially air, is injected into this hollow space, whereby the outer film layers are correspondingly tautened and the film pillow achieves its intended shape. The gas injected into the film pillow serves not only the shaping of the film pillow, but also for thermal insulating, which constitutes one of the advantages of the film system.

The support apparatus normally consists of a metal frame with a profiled cross section on which the film pillow is anchored via its fastening section. In this, the film layers are pressed together in the region of the anchoring and welded to each other. By this means, a good anchoring of the film layers and thus of the film pillow they form is ensured. However, it has become evident in practice that in the region of the anchoring the insulating action of the film system is essentially completely lost, since at that location the insulating air cushion is lacking.

It is therefore the task of the present invention to improve a building covering element of the type specified in the introduction such that a thermally insulating effect is maintained even in the region of the anchoring by means of the support apparatus.

This task is accomplished, in a building covering element of the type specified in the introduction, in that arranged in the fastening section of the film pillow is at least one thermally insulating element, and that the two outer film layers are spaced apart from each other through the thermally insulating element, the layers bearing on the latter.

Through the integration, according to the invention, of at least one thermally insulating element, which holds the two outer film layers at a distance from each other even in the fastening region, the cold bridge that previously developed is eliminated and the thermally insulating effect of the gas cushion is extended into the fastening section. Likewise, the thermally insulating element provided according to the invention itself contributes to the thermal insulating between the two outer film layers in the region of the anchoring, so that the thermally insulating element itself prevents the forming of a cold bridge.

A further advantage of the invention consists in the fact that the film layers, together with the thermally insulating element lying between the film layers, can be connected to each other in an appropriate gastight manner already during production in the factory, preferably welded together.

In a preferred embodiment of the invention, in which the support apparatus displays a contact section for the contact with the fastening section of the film pillow, the fastening section of the film pillow, together with the thermally insulating element arranged in the latter, can be brought into contact with the contact section. In a further development of this embodiment, in which the contact section displays two clamping sections between which the fastening section can be clamped, the fastening section of the film pillow, together with the thermally insulating element arranged in the latter, can be clamped between the clamping sections. Normally, the clamping sections are formed of metal sections.

In a further preferred embodiment of the invention, in which in the fastening section of the film pillow the outer film layers are connected directly to each other at a connection point, preferably welded, the thermally insulating element is arranged inside the hollow space of the film pillow adjacent to the connection point. Here, between the connection point and the adjacently arranged thermally insulating element, an additional, small gas cushion is usually formed, which cushion likewise has a thermally insulating effect. Moreover, in this arrangement the thermally insulating element prevents a cold bridge from the connection point to the gas-filled hollow space of the film pillow, so that the thermally insulating element exhibits an adequate insulating effect not only between the two outer film layers, but also at the outward-lying connection point.

In a further, at the present time, especially preferred embodiment, in which a piping film is attached to the fastening section of the film pillow, which piping film is connected to a piping cable outside the film pillow for fastening to the support apparatus, the piping film also encloses the thermal insulating element. Normally, the piping film also encloses the piping cable, with the two ends of the piping film being connected, preferably welded, to the film layers at the connection point.

Normally, the fastening section of the film pillow is anchored to the support apparatus at the connection point.

In a further embodiment of the invention, in which the fastening section forms a peripheral, flange-like edge section of the film pillow, the thermally insulating element forms a peripheral element.

Appropriately, the thermally insulating element is designed as a bridge.

The thermally insulating element should be connected to, preferably welded with, the outer film layers. For this purpose, for thermal separation a separating section, which consists e.g. of EPDM [ethylene propylene diene monomer], rubber, fiber materials, or other poorly heat-conducting materials, is placed inside the peripheral, edge-terminating sealing between the film layers and welded together such that a slipping is not possible.

Figure 2:
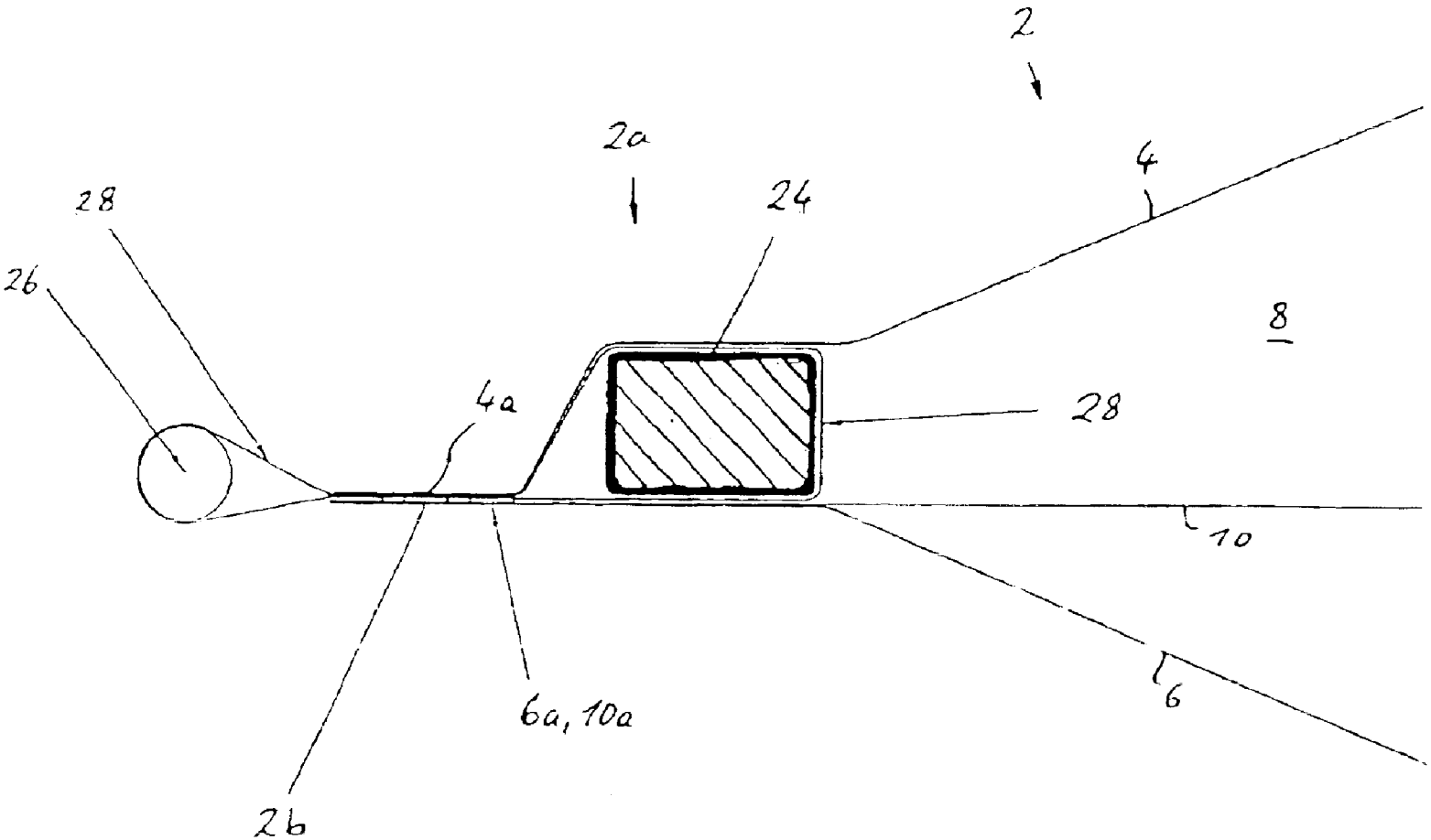

In the following, a preferred embodiment example of the invention is explained in detail with reference to the accompanying drawings. These show:

FIG. 1: schematically and in cross section, a detail of a film roofing system with a support apparatus and segments of film pillows fastened to the latter at both sides FIG. 2: a detail representation of a segment of a film pillow for the film roofing system shown in section in FIG. 1

Shown in FIG. 1 is a portion of a film roofing system that consists of a multiplicity of film pillows arranged adjacent to one another. In FIG. 1, for example two film pillows 2 are represented schematically as arranged next to each other; here, for reasons of simplicity and clarity, reference numerals are given only for the elements shown in the left half of FIG. 1 due to the symmetry of the representation.

The film pillows 2 represented in this embodiment example display an upper film 4 and a lower film 6, which enclose a hollow space 8 in a gastight manner. Air is injected into the hollow space 8, whereby the upper film 4 and the lower film 6 are correspondingly tautened and lend the film pillow 2 the desired shape. Accordingly, the upper film 4 and the lower film 6 form between themselves an air cushion in the hollow space 8. In the represented embodiment example, the film pillows 2 also display a middle film 10, which is provided for structural reasons and divides the hollow space 8 into an upper and a lower half.

The film pillows 2 display an edge section 2*a* that is peripheral and protrudes in a flange-like manner, by means of which edge section the pillows are anchored to the support apparatus 12. In the represented embodiment example, one film pillow 2 is anchored to each side of the support apparatus 12 and the support apparatus 12 consists of a cover section 14 and a base section 16.

In the edge section 2*a* of the film pillow, at one peripheral connection point 2*b* are welded together the ends 4*a*, 6*a*, and 10*a* of the upper film 4, the lower film 6, and the middle film 10. Arranged on the bottom of the clamp segment 14*a* of the cover section 14 is a sealing bar 18, preferably consisting of neoprene and essentially rectangular in cross section, and, below the latter, on top of the clamp segment 16*a* of the base section 16 is arranged a sealing layer 20, preferably consisting of EPDM; between the sealing bar 18 and the sealing layer 20 are situated the ends 4*a*, 6*a*, 10*a* of the films 4, 6, 10, which ends are welded together at the connection point 2*b*. With the aid of structure (not shown), the cover section 14 is pressed against the base section 16, whereby the welded-together ends 4*a*, 6*a*, 10*a*, of the films 4, 6, 10 at the connection point 2*b* make a sealing clamping contact with the upper sealing bar 18 and the lower sealing layer 20.

In the direction of the outer edge 14*b*, the clamp segment 14*a* of the cover section 14 displays an offset 14*c*, at the bottom of which is arranged a further sealing layer 22, likewise consisting preferably of EPDM. Through the offset 14*c* exists a larger gap or intermediate space between the clamp sections 14*a* and 16*a* of the two sections 14 and 16. At this location a thermally insulating element 24 is arranged in the edge section 2*a* of the film pillow 2, being arranged inside the film pillow 2 between the upper film 4, on the one hand, and the layer formed in common at this location by the lower film 6 and the middle film 10. Thus, the upper film 4 lies on the top of the thermally insulating element 24 and the film layer formed in common by the lower film 6 and the middle film 10 lies against the bottom of the thermally insulating element 24. Here, the films 4, 6, 10 are welded together with the thermally insulating element 24. In the represented embodiment example the thermal insulating element 24 has a rectangular cross section and consists of a peripheral bridge.

As can be further seen in FIG. 1, the edge section 2*a* of the film pillow 2, with the region incorporating the thermally insulating element 24, is likewise arranged between the clamp section 14*a*, 16*a* of the sections 14, 16 of the support apparatus 12, namely in the region of the offset 14*c* of the cover section 14. Here, the arrangement formed by the films 4, 6, 10 and the thermal insulating element 24 is situated against the upper sealing layer 22 attached to the bottom of the cover section 14 and against the sealing layer 20 sitting on top of the base section 16, and is thus bordered by these two sealing layers 20, 22.

The thermally insulating element 24, which should consist, for example, of EPDM, rubber neoprene, fibrous materials, or other poorly heat-conducting materials, serves to thermally insulate in the edge section 2*a* of the film pillow 2 the air cushion contained in the hollow space 8, toward the outward side as well as toward the support apparatus 12, and to prevent undesired cold bridges between the films 4, 6, 10 and the sections 14, 16 of the support apparatus 12. As can be seen in FIG. 1, between the connection point 2*b* where the ends of the films 4, 6, 10 are welded together and the thermally insulating element 24 that is spaced apart from this connection point 2*b* in the direction of the hollow space 8, on the one hand, and between the upper film 4 and the film layer formed in common by the lower film 6 and the middle film 10, on the other hand, is formed an additional, smaller hollow space 8*a*, in which an air cushion is likewise contained and also provides a thermally insulating effect. In order to further improve the thermally insulating effect of the entire arrangement, the sections 14 and 16 are additionally provided with thermally insulating measures. Normally, the sections 14, 16 consist of hollow sections of aluminum into which insulating material is inserted.

In the represented embodiment example, the anchoring of the film pillow 2 to the support apparatus takes place via this connection point 2*b*, as the load is taken up mainly by a piping cable 26 that rests in a hollow space 12*a* formed between the two sections 14, 16. For fastening of the piping cable 26 to the film pillow 2, a piping film 28 is provided, which film surrounds, on the one hand, the piping cable 26 and, on the other hand, the thermally insulating element 24, as can be seen especially in FIG. 2. For this purpose, the piping film 28 lies between the upper film 4 and the thermally insulating element 24, on the one hand, and between the thermally insulating element 24 and the film layer formed in common by the lower film 6 and the middle film 10, on the other hand, and moreover, in order to surround the piping cable 28, projects outwardly in a lateral fashion from the edge section 2*a* of the film pillow 2 at the connection point 2*b*, so that the piping cable 26 surrounds the film pillow 2 outside of the edge section 2*a*. Preferably, the ends of the piping film 28 (not shown in detail in the figures) are welded together with the ends of the films 4, 6, 10 at the connection point 2*b*.

In the above described, preferred embodiment example, it is a matter of a film roof element of a film roofing system. The described structure can just as well be used for the construction of a film facade element of a film facade system, or for the construction of another covering element for buildings.

What is claimed is:

1. A covering element for buildings, comprising:

a support apparatus;

a film pillow including two outer film layers, the two outer film layers encapsulating an airtight, gas-filled, hollow space; and an edge section that anchors the film pillow to the support apparatus and connects the two outer film layers to each other, the edge section including a thermally insulating element disposed between the two outer film layers so that the two outer film layers are spaced apart from each other and rest upon the thermally insulating element.

2. The covering element of claim 1, wherein the support apparatus includes a contact section that connects to the edge section proximate the thermally insulating element.

3. The covering element of claim 2, the contact section comprising two clamp segments, wherein the edge section and thermally insulating element can both be clamped between the two clamp segments.

4. The covering element of claim 3, wherein the two clamp segments are made of metal.

5. The covering element of claim 1, wherein the two outer film layers are directly connected to each other at a connection point, wherein the thermally insulating element is located inside the hollow space adjacent to the connection point.

6. The covering element of claim 5, further comprising:

a piping cable located outside the film pillow; and a piping film with two ends that surrounds the thermally insulating element and connects the edge section to the support apparatus.

7. The covering of claim 6, wherein the piping cable surrounds the piping film, and wherein the two ends of the piping film are connected to the two outer film layers at the connection point.

8. The covering of claim 7, wherein the edge section forms a peripheral, flange-like edge section, and wherein the thermally insulating element forms a peripheral element.

9. The covering of claim 5, wherein the edge section is attached to the support apparatus at the connection point.

10. The covering of claim 1, wherein the thermally insulating element is designed as a bridge.

11. The covering of claim 1, wherein the thermally insulating element is connected to the two outer film layers.

* * * * *